US012808015B2

(12) United States Patent
Du Plessis et al.

(10) Patent No.: US 12,808,015 B2
(45) Date of Patent: Nov. 24, 2026

(54) ALKALINE OXIDATION PROCESS AND DEVICE FOR TREATING REFRACTORY SULFIDE ORE, IN PARTICULAR REFRACTORY GOLD ORE

(71) Applicant: S.A. Lhoist Recherche et Developpement, Ottignies Louvain-la-Neuve (BE)

(72) Inventors: Chris Du Plessis, Ottignies-Louvain-la-Neuve (BE); Hugues Lambert, Ottignies-Louvain-la-Neuve (BE); Alireza Rabieh, Salter Point (AU); Jacobus Johannes Eksteen, Bull Creek (AU)

(73) Assignee: S.A. Lhoist Recherche et Developpement, Ottignies Louvain-la-Neuve (BE)

( * ) Notice: Subject to any disclaimer, the term of this patent is extended or adjusted under 35 U.S.C. 154(b) by 106 days.

(21) Appl. No.: 17/776,448

(22) PCT Filed: Jul. 16, 2021

(86) PCT No.: PCT/EP2021/069927
§ 371 (c)(1),
(2) Date: May 12, 2022

(87) PCT Pub. No.: WO2022/013414
PCT Pub. Date: Jan. 20, 2022

(65) Prior Publication Data

US 2023/0128925 A1 Apr. 27, 2023

(30) Foreign Application Priority Data

Jul. 16, 2020 (EP) ..... 20186290

(51) Int. Cl.
*C22B 3/12* (2006.01)
*C22B 1/24* (2006.01)
(Continued)

(52) U.S. Cl.
CPC ..... *C22B 3/12* (2013.01); *C22B 1/24* (2013.01); *C22B 3/22* (2013.01); *C22B 11/04* (2013.01);
(Continued)

(58) Field of Classification Search
CPC .... C22B 3/12; C22B 3/22; C22B 3/00; C22B 3/20; C22B 3/04; C22B 11/00;
(Continued)

(56) References Cited

U.S. PATENT DOCUMENTS 6,833,021 B1 * 12/2004 Hourn ..... C22B 3/12 423/28

FOREIGN PATENT DOCUMENTS

EP 1171641 B1 1/2002
GB 1404243 A 8/1975
(Continued)

OTHER PUBLICATIONS

Knott, Theresa. Lime—a time-tested chemical, May 17, 2017, The University of Waikato Te Whare Wānanga o Waikato (Year: 2017).*
(Continued)

*Primary Examiner* — Keith D. Hendricks
*Assistant Examiner* — Nikolas Takuya Pullen
(74) *Attorney, Agent, or Firm* — J. Miguel Hernandez; Charles D. Gunter, Jr.; Whitaker Chalk Swindle & Schwartz PLLC

(57) ABSTRACT

Alkaline oxidation process for treating refractory sulfide ore or concentrate particles enriched in a metal to be recovered comprising stages in which refractory ore or concentrate particles are surface-oxidized in an alkaline oxidation step in
(Continued)

alkaline liquid phase with calcium hydroxide forming an alkaline slurry, which slurry is thereafter mechanically activated to remove passivating coatings from the surface oxidized refractory ore particles.

3 Claims, 2 Drawing Sheets

(51) Int. Cl.
*C22B 3/00* (2006.01)
*C22B 3/22* (2006.01)
*C22B 11/00* (2006.01)
*C22B 15/00* (2006.01)

(52) U.S. Cl.
CPC ..... *C22B 15/008* (2013.01); *C22B 15/0086* (2013.01); *C22B 19/24* (2013.01); *C22B 23/0407* (2013.01)

(58) Field of Classification Search
CPC .. C22B 11/04; C22B 1/00; C22B 1/14; C22B 1/24; C22B 15/00; C22B 15/0063; C22B 15/0065; C22B 15/008; C22B 19/00; C22B 19/20; C22B 19/24; C22B 23/00; C22B 23/0407; C22B 23/04
See application file for complete search history.

(56) References Cited

FOREIGN PATENT DOCUMENTS

| | | | |
|---|---|---|---|
| WO | 2006064350 | A1 | 6/2006 |
| WO | 2016081799 | A1 | 5/2016 |

OTHER PUBLICATIONS

Engineering ToolBox, (2004). Solubility of Air in Water. (Year: 2004).*
J.D.Pease, M.F. Young, D. Curry, N.W.Johnson. Improving Fines Recovery By Grinding Finer, 2004, MetPlant (Year: 2004).*
Dr Claire Vallance, Reaction Kinetics, Nov. 21, 2010, Oxford University (Year: 2010).*
International Patent Application PCT/EP2021/069927 International Search Report and Written Opinion, 11 pages, Nov. 2, 2021.

* cited by examiner

ALKALINE OXIDATION PROCESS AND DEVICE FOR TREATING REFRACTORY SULFIDE ORE, IN PARTICULAR REFRACTORY GOLD ORE

The present invention relates to an alkaline oxidation process for treating refractory sulfide ore particles enriched in a metal to be recovered, i.e., prior to extraction and recovery of such metal, as well as to a device for such alkaline oxidation process.

Gold and other precious metals as well as some base metals are extracted from sulfide ores by treatment with a cyanide solution which solubilizes the gold and said other metals in the presence of oxygen.

In the cyanide leaching process, solid metallic gold (AuO) is oxidized (to $Au^+$) by sparged oxygen and is maintained in soluble form as a gold-cyanide complex ($Au(CN)^{2-}$) via the overall reaction illustrated below using sodium cyanide as an example, prior to recovery by adsorption onto activated carbon and subsequent processing:

$$4Au+8NaCN+O_2+2H_2O=4Na[Au(CN)_2]+4NaOH$$

Cyanidation leaching of gold needs to occur at alkaline pH conditions, preferably at pH 11, to maintain cyanide in an anionic solution form ($CN^-$) for use in the gold dissolution. At pH levels below 11, and particularly below 9, soluble cyanide is converted to hydrogen cyanide (HCN) that is both ineffective as a leaching agent and prone to evaporation as a toxic gas released from the aqueous phase. It is, therefore, imperative to increase the aqueous mineral slurry pH and maintain it at a safe and effective level, which imposes a reagent consumption demand, most often in the form of quicklime (with active reagent CaO) as the most economical alkalizing reagent. Quicklime is converted to its hydrated form, $Ca(OH)_2$, when in contact with water and may be utilized in either $Ca(OH)_2$ or CaO formats.

In some ores, the gold or other metal is termed "refractory" to recovery by cyanidation. There are several features that may cause ores to be refractory: (1) The presence of carbonaceous matter that adsorbs (i.e. robs) gold from the pregnant solution (containing cyanide-dissolved gold) thereby reducing recovery, leading to the term "preg-robbing" ore. The most common form of refractory ore is caused by the presence of sulfide minerals, such as pyrite or arsenopyrite. Sulfide refractory ore (or concentrate) is the most commonly encountered refractory ore where fine gold particles are co-contained and often occluded within a matrix of sulfide minerals, most commonly pyrite ($FeS_2$) or arsenopyrite (FeAsS).

Such gold is not sufficiently liberated and therefore not sufficiently accessible to lixiviants, of which cyanide is the most commonly used. Even if sufficiently liberated the presence of sulfide minerals contributes to uneconomically high cyanide reaction consumption because of the overwhelming unwanted side-reaction of sulfide minerals with cyanide, to form thiocyanate ($SCN^-$) that is less effective as a gold lixiviant.

$$4FeS_2+8NaCN+3O_2+6H_2O=8NaSCN+4Fe(OH)_3$$

Because of the predominance of sulfide refractory ore, the term "refractory" in the rest of this text is meant to refer to sulfide refractory ore (or concentrate) rather than preg-robbing ore.

To solve the aforementioned difficulties, there are several well-known processing options, as pre-treatment before cyanidation, which are available to recover gold from sulfide-refractory ore, most commonly after it has been upgraded to a concentrate via a mineral flotation process [Aylmore et al., 2012. Evaluating process options for treating some refractory ores DOI: 10.13140/2.1.4325.9842 Conference: ALTA 2012 INTERNATIONAL GOLD CONFERENCE, Perth, Australia].

Such available pre-treatment process options are further described in La Brooy et al., Review of gold extraction from ores, Minerals Engineering, [Volume 7, Issue 10, 1994, Pages 1213-1241, https://doi.org/10.1016/0892-6875(94)90114-7], and are carried out either via roasting or hydrometallurgical methods that range from high temperature (up to 250 °C), pressure oxidation in autoclaves to bacteria catalyzed oxidation at atmospheric pressure and mild temperature conditions (35-45 °C in the case of mesophilic bacteria and up to 80 °C for archaea systems).

A first option available is a roasting pre-treatment. Roasting is conducted at temperatures of approximately 800 °C in the presence of oxygen-containing gas, resulting in the oxidation of sulfides into sulfate solids and gaseous sulfur dioxide. The generation of sulfur dioxide gas is problematic and needs to be collected, generally by conversion into sulfuric acid. The roasting process and capital requirements are further complicated when arsenic is present in the refractory ore. After calcination, the residual gold-containing material, can be subjected to conventional gold cyanidation processes.

Another option available is pressure oxidation. Pressure oxidation is a hydrometallurgical processing method in which refractory concentrate (typically with a $P_{80}$ 150 μm) is oxidized in an autoclave by the introduction of oxygen gas into aqueous media under elevated pressure and temperature conditions, typically 200 °C and 3,100 kPa for up to 60 minutes.

The notation $P_X$ represents a diameter expressed in μm, compared to which the size of X % by volume of the particles measured are less than or equal to this diameter. For example, $P_{80}$ 150 μm means that 80% by volume of the particles have a diameter smaller than or equal to 150 μm. The particle size distribution of a sample can be determined by different methods, known in the art, for example by laser diffraction according to the standard ISO 13320-2020.

The reaction below illustrates pyrite oxidation (by way of example) as is typically achieved in an autoclave, generating hematite and sulfuric acid.

$$4FeS_2+15O_2+8H_2O=2Fe_2O_3+8H_2SO_4$$

A portion of the iron contained in pyrite remains in solution as ferric iron sulfate because of the high acid levels preventing all ferric iron precipitating.

$$4FeS_2+15O_2+2H_2O=4Fe^{3+}+6SO_4^{2-}+2H_2SO_4$$

A further available option is bacterial bio-oxidation. Bacterial bio-oxidation is a hydrometallurgical processing method in which refractory concentrate (typically $P_{80}$<150 μm) is oxidized in aqueous media at atmospheric pressure and mild temperature 35-45 °C, where sulfide mineral oxidation is catalyzed by iron- and sulfur-oxidizing bacteria in a cascade of reactors with a total residence time of approximately 4 days. While bacteria cope well with impurities such as arsenic, they have a low tolerance for chloride (above approximately 1 g/dm$^3$), thereby prohibiting the use of seawater (chloride content of approximately 17 g/dm$^3$). Similar pyrite oxidation reactions occur during biooxidation as earlier illustrated for pressure oxidation, but the ambient pressure conditions of biooxidation result in iron precipitating as jarosite rather than hematite.

Alternatively, there also exist ultra-fine grinding methods ($P_{80}$ 25 μm), such as the Albion process, disclosed in EP 1 171 641. According to this document, ultra-fine grinding methods are employed to improve the leaching rate under atmospheric conditions in the presence of oxygen, but at the expense of increased grinding costs. In this method, all of the material to be treated is subjected to grinding to reduce mineral particle size, prior to leaching in alkaline conditions. Unfortunately, this process is energy intensive. As disclosed in EP 1 171 641, the alkaline leaching of refractory sulfide and/or carbonaceous materials can only be successfully achieved by careful selection of the particle size of the material to be leached. A similar method with previous ultra-fine grinding of the refractory ore is disclosed in WO2006/064350.

A more recent alternative is an acidic leaching process by FLSmidt called the Rapid Ore Leaching process (as disclosed in WO 2016/100981) which makes use of alternating grinding (stirred media reactors) and leaching, in acid environments for base metal recovery.

Leaching inside a mill was also proposed in Patent CN1228480 which teaches a process in which milling and oxidation occur simultaneously in the same reactor without separation between the oxidation step and the surface attritioning/milling. The problem with such an approach is that the oxidation and milling cannot be independently controlled.

Several of the above hydrometallurgical methods, such as FLSmidt's Rapid Ore Leaching process, will yield acidic conditions in the bulk of the slurry.

Acid generation is a consequence of most aqueous pyrite oxidation processes and has three important negative consequences:

1. The combination of acidic and oxidative process conditions (dissolved oxygen and ferric iron) is particularly corrosive, thus requiring special materials of construction that, in turn, impose significant capital equipment costs for the pressurized reactor vessels. The corrosive conditions are further exacerbated by the use of chloride-containing water as is contained in seawater. These features increase capital equipment complexity and costs.
2. The generation of acid during hydrometallurgical sulfide mineral oxidation also causes significant dissolution of gangue minerals contained in the ore or concentrate. Dissolved gangue elements such as Fe, Al, Mn, Mg and others, require precipitation for removal from solution prior to process solution re-use or disposal. These gangue element precipitation reactions also typically require a combination of calcium carbonate (effective at pH levels<4.5 for Fe and Al removal) and lime (effective at pH levels up to 12 for precipitation of elements that precipitate as hydroxides at elevated pH levels). The precipitation reagents required, incur significant costs.
3. Acidic conditions are contrary to the alkaline conditions required in the subsequent gold cyanidation leaching process. The oxidized slurry therefore requires the addition of large quantities of base reagents to render the pH conducive to cyanidation leaching of gold.

As it can be seen from industrial practice, the available hydrometallurgical process options present problems of acid generation. To overcome these challenges, alkaline sulfide mineral oxidation methods have been proposed, where the absence of acid would avoid the problems of corrosion and gangue mineral dissolution [Bahkta et al., 1989. Alkaline oxidative leaching of gold-bearing arsenopyrite ores. Report of investigations (United States of America Bureau of Mines): 9258. Supt. Docs no: 128.23:9258]. Alkaline reagents that have previously been considered for this purpose have included, amongst others, NaOH, $Na_2CO_3$, NaOCl and KOH. Unfortunately, the use of these reagents, however, poses a number of problems:

1. The monovalent cations (such as $Na^+$) associated with these reagents typically remain soluble and are not readily removed from solution circuits by precipitation reactions. This, in turn, causes secondary environmental, regulatory or license-to-operate issues because of process circuit discharge and seepage into underground- or open water sources.
2. These reagents are relatively expensive.

Further, Bidari et al. studied the alkaline oxidation of pyrite in the presence of calcite and dolomite and highlighted the formation of a surface layer containing Ca (in the case of calcite) and Mg (in the case of dolomite) on the pyrite surface, which ascribed to be the cause of the slowdown in pyrite leaching rate. Pyrite alkaline oxidation rate decreased in the presence of both calcite and dolomite, while a more detrimental effect was observed in the case of calcite (see "*Pyrite oxidation in the presence of calcite and dolomite: Alkaline leaching, chemical modelling and surface characterization*" in Trans. Nonferrous Met. Soc. China 28(2018) 1433-1443).

Caldeira et al. studied the alkaline oxidation of pyrite with different alkaline solutions to characterize the nature of a product layer formed at the surface of the oxidized pyrite. A comparison between different alkaline reagents was performed, such as with sodium or calcium hydroxide and sodium carbonate. Caldeira et al., 2003 reported that a " . . . very low oxidation of pyrite was obtained in the presence of lime" compared to sodium carbonate which does not result in gypsum formation [C. L Caldeira, V. S. T Ciminelli, A Dias, K Osseo-Asare, Pyrite oxidation in alkaline solutions: nature of the product layer, International Journal of Mineral Processing, Volume 72, Issues 1-4, 2003, Pages 373-386].

Alkaline oxidation conditions have advantages compared to acidic conditions, but has a number of drawbacks: (1) alkali reagents such as sodium hydroxide, ammonium hydroxide or potassium hydroxide are expensive reagents and pose environmental risks because of the inability to readily remove the associated cation from processing circuits, while (2) calcium based alkali reagents have been demonstrated to cause passivation of pyrite and thereby work counter to the objective of oxidizing refractory ore.

There is, therefore, a need to provide oxidation of sulfide minerals for recovering metal in the sulfide mineral having the minimal impact on environment, either in terms of impact or treatment of disposal, further allowing the use of diverse source of water and where the capital equipment costs remain reasonable.

It is an objective of the present invention to compensate at least partly for these drawbacks by providing an alkaline oxidation process of refractory sulfide ore particles for recovering metal which is entrapped in or co-occurring such sulfide minerals which involves less expensive alkaline agent, allows the use of diversified sources of water and where the capital equipment costs and energy consumption remain at an acceptable level.

To this end, the present invention relates to an alkaline oxidation process for treating refractory sulfide ore particles enriched in a metal to be recovered wherein refractory ore particles are submitted to at least 3 stages in each of which said refractory sulfide ore particles are oxidized in surface by an oxidizing agent in an alkaline oxidation step in alkaline liquid phase and form an alkaline slurry containing surface oxidized refractory sulfide ore particles and in each of which said alkaline slurry is thereafter submitted to a mechanical activation step for removing from the surface oxidized refractory sulfide ore particles at least partly a surface layer containing oxidized matter, said mechanical activation forming a mechanically activated slurry containing oxidized matter, refractory sulfide ore particles from which oxidized matter has been removed, alkaline liquid phase and liberated metal to be recovered by further processing or returned to a next or a previous alkaline oxidation step, said alkaline liquid phase containing calcium hydroxide as alkaline agent.

According to the present invention and against all expectations, it has been possible to perform efficiently a lime based alkaline oxidation step of refractory sulfide ore particles for extracting a metal of interest. While the literature was strongly teaching away from the use of an alkaline calcium reagent compound because the surface coating effect of lime creating a passivation layer that prevents further oxidation of the refractory ore, the yield of the oxidation process according to the present invention was comparable to other acid or alkaline oxidation leaching but more economical and without the drawbacks of the prior art.

Indeed, US Patent 2016/0258038A1 states that " . . . leaching of iron sulfide materials with lime has been unsuccessful in that leaching is incomplete and subsequent precious metal recovery is low. For example, an earlier study of alkaline oxidation of pyrite for gold recovery using lime achieved only 30 to 40% gold recovery which offered little improvement over direct cyanidation of the pyrite. This is believed to be due to passivation of the mineral by precipitation of a gypsum/iron oxide layer."

Further, in copper sulfide mineral processing, pyrite occurs as an unwanted sulfide mineral that needs to be rejected during processing. This is typically achieved by inducing surface coating effects partly attributed to lime. For example Hu et al. 2000, notes that: "Well known phenomenon of the depression of pyrite by lime is attributed to the surface formation of $Ca(OH)_2$, $CaSO_4$ and $Fe(OH)_3$ as determined by XPS analysis" [Hu et al., J. D. (2000). Surface chemistry of activation of lime-depressed pyrite in flotation. Transactions of Nonferrous Metals Society of China (English Edition), 10(6), 798-803.]

Pyrite oxidation is the main cause of acid mine drainage (also called acid rock drainage). Acid mine drainage prevention therefore focusses on preventing the oxidation of pyrite. An article by Qian 2017 states that: "treatment with lime-saturated water was found to be of paramount importance for maintaining long-term circum-neutral pH, favourable for the formation and preservation of the pyrite surface passivating layer and reduced acid generation rate" [Qian, Gujie & Schumann, Russell & Li, Jun & Short, Michael & Fan, Rong & Li, Yubiao & Kawashima, Nobuyuki & Zhou, Yan & St. C. Smart, Roger & R. Gerson, Andrea. (2017). Strategies for Reduced Acid and Metalliferous Drainage by Pyrite Surface Passivation. Minerals. 7. 1-15. 10.3390/min7030042.]

According to the present invention, it has been identified that it is possible to use lime during alkaline oxidation of refractory sulfide ore particles enriched in a metal to be recovered after at least 3 stages of alkaline oxidation with intermittent mechanical activation. During each alkaline oxidation step, a slurry is formed in which the refractory ore particles are oxidized. Thereafter the slurry is mechanically activated to remove or alter the passivation layer around the refractory ore particles in a mechanical activation step, under the form of an attrition step or milling step. The attrition step or milling step is performed during a relatively short residence time to only remove or alter the passivation layer and to limit the energy requirements for this mechanical activation step. Thereafter, the mechanically activated slurry is again submitted to a new and second stage of alkaline oxidation-mechanical activation. During the alkaline oxidation step of the second stage, the remaining portion of the refractory ore particles is further surface-oxidized and become coated with a new passivation layer (forming a second slurry). The new passivation layer is further removed or altered during a subsequent attrition or milling step of the second slurry and forms a second mechanically activated slurry. The second mechanically activated slurry is further submitted to a third stage of alkaline oxidation step and mechanical activation step. During the alkaline oxidation step of the third stage, the remaining portion of the refractory ore particles is further oxidized in surface and surrounded with a new passivation layer (forming a third slurry). Thereafter the new passivation layer is removed or alter during a subsequent attrition or milling step of the third slurry and forms a third mechanically activated slurry. The third mechanically activated slurry is either collected for further processing or submitted to a next alkaline oxidation step, possibly by being beforehand returned to (so looping with) the previous alkaline oxidation step through the third mechanical activation step.

The number of stages is at least three and can be further increased depending on the particle size of the refractory ore particles. In addition, the residence time for each alkaline oxidation step can be the same or different from one to each other and will be defined taking into account the constraints of the process.

An unexpected finding of the present invention was that refractory ore particles could be oxidized to a substantial extent with the use of lime as alkaline agent under oxidation conditions that are otherwise known for generating a passivation layer, normally considered as an obstacle to oxidation. This was achieved by facilitating oxidation under alkaline conditions using a lime reagent, and subsequent removal/alteration of the surface passivation layer to further generate a new "active" surface and accordingly, reduce the main diameter of each refractory ore particles step by step by the stages in the process according to the present invention.

In a preferred embodiment of the alkaline oxidation process according to the present invention, said at least 3 stages comprise:

- a series of n alkaline oxidation steps in a series of n agitated reactors, each $n^{th}$ alkaline oxidation forming a $n^{th}$ alkaline slurry, where n is an integer comprised between 3 and 10, preferably between 4 and 8, more preferably between 5 and 7,
- a series of x mechanical activation steps, each mechanical activation step being a mechanical activation of said $n^{th}$ alkaline slurry, where x is an integer, equal or lower than n, and comprised between 3 and 10, preferably between 4 and 8, more preferably between 5 and 7, wherein said series of n alkaline oxidation steps comprises at least:

- a first alkaline oxidation step wherein said refractory sulfide ore particles enriched in a metal to be recovered are fed into an agitated reactor and form a first alkaline slurry,
- at least one intermediate alkaline oxidation step fed with one alkaline slurry from a previous alkaline oxidation step, a last alkaline oxidation step being said $n^{th}$ alkaline oxidation step fed with one alkaline slurry from a previous alkaline oxidation step, said series of x mechanical activation steps comprising at least:

a first mechanical activation step of said first alkaline slurry in a first mechanical activation means to form a first mechanically activated slurry, at least one intermediate mechanical activation step of a $n^{th}$ alkaline slurry with said $n^{th}$ alkaline slurry being comprised between a $2^{nd}$ alkaline slurry and a $(x-1)^{th}$ alkaline slurry in an intermediate ($y^{th}$) mechanical activation means to form an intermediate ($y^{th}$) mechanically activated slurry, a last mechanical activation step of said last alkaline slurry being said $x^{th}$ mechanical activation step in a final ($x^{th}$) mechanical activation means to form a final ($x^{th}$) mechanically activated slurry.

According to the present invention, said refractory ore is a refractory sulfide ore or concentrate enriched in a metal selected among gold, silver, platinum, palladium, copper, nickel, zinc, cobalt and combinations thereof, particularly pyrite or arsenopyrite containing said metal or combination of metals, such as gold-containing pyrite ore or concentrate, gold containing arsenopyrite ore or concentrate, copper sulfide ore or concentrate, nickel sulfide ore or concentrate, zinc sulfide ore or concentrate or cobalt sulfide ore or concentrate and combined metal sulfide ore or concentrate such as low grade copper-gold sulfide ores or concentrates.

In addition, according to the present invention, said oxidizing agent is an oxidizing liquid, an oxidizing powder or an oxidizing gas, such as oxygen, ozone, and their mixture.

In case of oxygen, oxygen is preferably in the form of dissolved oxygen in the solution to be available for the reaction. Oxygen may be supplied to the oxidation steps via sparging of gas, under conditions that optimize the mass transfer of oxygen from the gas phase into the liquid phase. Gas sparging may occur via several methods well-known by the skilled person, for example by means of a sparge ring, sparge jet impellers or supersonic gas injectors.

Further, in a particular embodiment, said calcium hydroxide of said alkaline liquid phase is obtained by one or more addition of dry quicklime CaO, hydrated lime $Ca(OH)_2$ or a milk of lime also known as slaked lime being a slurry of $Ca(OH)_2$ and water, said one or more addition being chosen amongst an addition upstream one $n^{th}$ reactor, in one $n^{th}$ reactor, upstream a $x^{th}$ mechanical activation means, in a $x^{th}$ mechanical activation means or combination thereof.

More specifically, in the process according to the present invention, each intermediate alkaline oxidation step is fed by a previous alkaline oxidation step, optionally via a mechanical activation step.

For example, in one advantageous embodiment of the process according to the present invention, x=n and each $n^{th}$ alkaline oxidation step of said series of n alkaline oxidation step is followed by a $x^{th}$ mechanical activation step of said series of x mechanical activation steps (with the number of the series $x^{th}$ being normally equal to the number of the series $n^{th}$ but not mandatorily), each $n^{th}$ (from second), i.e. each amongst the at least one intermediate alkaline oxidation step and last alkaline oxidation step being fed by a $x^{th}$ mechanically activated slurry where x=n−1.

In another exemplary embodiment according to the present invention, x=n and each $n^{th}$ alkaline oxidation step of said series of n alkaline oxidation step is followed by a $x^{th}$ mechanical activation step of said series of x mechanical activation steps (with the number of the series $x^{th}$ being normally equal to the number of the series $n^{th}$ but not mandatorily), each $n^{th}$ (from second), i.e. each amongst the at least one intermediate alkaline oxidation step and last alkaline oxidation step being fed by a $(n-1)^{th}$ slurry from a (n−1) agitated reactor to which a $(n-1)^{th}$ mechanically activated slurry is returned.

In a further exemplary embodiment according to the process of the present invention, x is different from n, hence lower than n. In this exemplary embodiment, the process comprises several intermediate alkaline oxidation steps and some intermediate alkaline oxidation steps of said series of n alkaline oxidation step are followed by a mechanical activation step. In one sub-variant of this exemplary embodiment, each $n^{th}$ intermediate alkaline oxidation step forming a $n^{th}$ slurry is fed by a $(n-1)^{th}$ slurry from the $(n-1)^{th}$ agitated reactor, optionally subsequently mechanically activated. In another sub-variant of this exemplary embodiment, each $n^{th}$ alkaline oxidation step forming a $n^{th}$ slurry is fed from a $(n-1)^{th}$ agitated reactor optionally to which a $x^{th}$ mechanically activated slurry with $x<(n-1)$ is returned.

According to the present invention, it is foreseen that mechanical activation is achieved by at least one comminution device, i.e., can be made by a single comminution device or two, three or more sequentially ordered comminution devices in parallel and/or in series, between two sequential alkaline oxidation steps.

In an advantageous embodiment of the process according to the present invention, at least one alkaline oxidation step, preferably more than one alkaline oxidation step and more preferably each alkaline oxidation step of said series of n alkaline oxidation steps is performed at atmospheric pressure.

In another advantageous embodiment of the process according to the present invention, at least one alkaline oxidation step, preferably more than one alkaline oxidation step and more preferably each alkaline oxidation step of said series of n alkaline oxidation steps is performed at a temperature comprised between 70 and 100 °C, preferably between 80 and 95 °C, more preferably between 80 °C and 90 °C.

In a further particular embodiment of the process according to the present invention, at least one alkaline oxidation step, preferably more than one alkaline oxidation step and more preferably each alkaline oxidation step of said series of n alkaline oxidation steps is performed with a dissolved oxygen content comprised between 1 and 30 $mg/dm^3$, preferably between 5 and 25 $mg/dm^3$, more preferably higher than 10 $mg/dm^3$ and in particular between 10 and 20 $mg/dm^3$ of liquid phase.

In the process according to the invention it is particularly possible to apply oxygen-limiting conditions to facilitate pyrite oxidation to result in ferric iron precipitate, that is substantially reduced in sulfate content (for example hematite rather than jarosite), and in sulfur, that is preferably soluble (i.e. thiosulfate or other soluble polysulfide rather than gypsum). Such conditions allow to obtain a reduction of sulfate-containing iron precipitates and gypsum precipitate. In these conditions the alkaline oxidation steps are preferably performed with a dissolved oxygen content comprised between 1 and 5 $mg/dm^3$, advantageously of 4 $mg/dm^3$ of liquid phase.

Preferably, in the process according to the present invention, at least one alkaline oxidation step, preferably more than one alkaline oxidation step and more preferably each alkaline oxidation step of said series of n alkaline oxidation steps is performed at a pH comprised between 10 and 12.5, preferably comprised between 10 and 12 and in particular between 10.5 and 11.5, said pH being controlled with a controlled addition of said alkaline agent which as above disclosed is a lime reagent.

More preferably, in the process according to the present invention, at least one alkaline oxidation step, preferably more than one alkaline oxidation step and more preferably each alkaline oxidation step of said series of n alkaline oxidation steps is performed with solid content in the stirred reactor comprised between 10 and 70 wt %, preferably, between 20 and 70 wt %, more preferably between 35 and 70 wt %, more particularly between 40 and 65 wt % with respect to the total weight contained in said stirred reactor.

In particular, in the process according to the present invention, at least one of said series of x mechanical activation steps is performed in a vertical mill, a vertical stirred mill, a horizontal mill, an attritor, a stirred ball mill or a horizontal stirred mill.

Advantageously, in the process according to the present invention, said refractory sulfide ore particles fed to said first alkaline oxidation step are obtained by a previous crushing and grinding, advantageously down to having 80% of the particles with a diameter in the range between 25 and 200 μm, preferably between 25 and 150 μm. most preferably between 30 and 120 μm. Such $P_{80}$ is measured by laser diffraction according to the standard ISO 13320-2020.

Preferably, in the process according to the present invention, said crushed and ground refractory ore particles are subjected to mineral flotation to produce a concentrate of refractory sulfide ore particles fed to said first alkaline oxidation step.

Other embodiments of the process according to the present invention are mentioned in the appended claims.

The present invention also relates to a device for alkaline oxidation of refractory sulfide ore particles enriched in a metal to be recovered comprising:

- a series of n agitated reactors for alkaline oxidation where n is an integer comprised between 3 and 10, preferably between 4 and 8, more preferably between 5 and 7,
- a series of x mechanical activation means where x is an integer equal or lower than n and comprised between 3 and 10, preferably between 4 and 8, more preferably between 5 and 7, and
- a collection means for feeding a process for recovering said metal, said device further comprising a lime reagent feeding means connected to at least one agitated reactor or to at least one mechanical activation means or both.

By the wording "said device further comprising a lime reagent feeding means connected to at least one agitated reactor or to at least one mechanical activation means or both", it is meant that lime can be fed to all or any number of the alkaline oxidation reactors and/or mechanical activation means.

Advantageously, in the device according to the present invention, at least one agitated reactor, preferably at least 3 agitated reactors, more preferably each agitated reactor, comprises sparging means for feeding an oxidizing gas.

In a particular embodiment of the device according to the present invention, said lime feeding means comprises a further stirred vessel to suspend calcium hydroxide powder in a liquid phase connected to a lime reagent pump.

In a particular embodiment of the device according to the present invention, at least one intermediate $n^{th}$ agitated reactor of said series of n agitated reactors is connected on one side to a previous $(n-1)^{th}$ agitated reactor, optionally via a mechanical activation means, and on the other side to a following $x^{th}$ mechanical activation means of said series of x mechanical activation means.

In another particular embodiment of the device according to the present invention, at least one intermediate $n^{th}$ agitated reactor of said series of n agitated reactor is connected on one side to a previous $(n-1)^{th}$ agitated reactor, optionally via a mechanical activation means, and on the other side to a following $(n+1)^{th}$ agitated reactor of said series of n agitated reactors.

For example, in one exemplary embodiment of the device according to the present invention, x=n and each $n^{th}$ (from second), i.e. each amongst the at least one intermediate agitated reactor and last agitated reactor of said series of n agitated reactor is connected to a $x^{th}$ mechanical activation means of said series of x mechanical activation means for feeding the $x^{th}$ mechanical activation means with a $n^{th}$ slurry of surface oxidized refractory ore particles, said $x^{th}$ mechanical activation means being connected to a $(n+1)^{th}$ agitated reactor for feeding said $(n+1)^{th}$ agitated reactor with a $x^{th}$ mechanically activated slurry.

In another exemplary embodiment of the device according to the present invention, x=n and each $n^{th}$ (from second), i.e. each amongst the at least one intermediate agitated reactor and last agitated reactor of said series of n agitated reactor is connected to a $x^{th}$ mechanical activation means of said series of x mechanical activation means for feeding the $x^{th}$ mechanical activation means with a $n^{th}$ slurry of surface oxidized refractory ore particles, said $x^{th}$ mechanical activation means being connected (inwards and outwards) to said $n^{th}$ agitated reactor for returning (looping) said $x^{th}$ mechanically activated slurry to said $n^{th}$ agitated reactor, the $(n+1)^{th}$ agitated reactor being connected to said $n^{th}$ agitated reactor to be fed by a flow from said $n^{th}$ agitated reactor.

In yet another exemplary embodiment according to the present invention, x is different from n, hence lower than n. In this exemplary embodiment, the process comprises several intermediate agitated reactors and some intermediate agitated reactors of said series of n agitated reactors are followed by a mechanical activation step. In one sub-variant of this exemplary embodiment, each $n^{th}$ intermediate agitated reactor forming a $n^{th}$ slurry is connected to a $(n-1)^{th}$ agitated reactor and fed by a flow from said $(n-1)^{th}$ agitated reactor, optionally subsequently mechanically activated. In another sub-variant of this exemplary embodiment, each $n^{th}$ intermediate agitated reactor forming a $n^{th}$ slurry is fed from a $(n-1)^{th}$ agitated reactor optionally to which a $x^{th}$ mechanically activated slurry with $x<(n-1)$ is returned.

According to the present invention, it is foreseen that a mechanical activation means is made by at least one comminution device, i.e., can be made by a single comminution device or two, three or more sequentially ordered comminution devices in parallel and/or in series, between two sequential alkaline oxidation steps.

Preferably, in the device according to the present invention, at least one agitated reactor, preferably each agitated reactor of said series of n agitated reactor comprises heating means.

More particularly, in the device according to the present invention, at least one mechanical activation means of said series of x mechanical activation means is a vertical mill, a vertical stirred mill, a horizontal mill, an attritor, a stirred ball mill or a horizontal stirred mill.

Other embodiments of the device according to the present invention are mentioned in the appended claims.

Other characteristics and advantages of the present invention will be derived from the non-limitative following description, and by making reference to the drawings.

In the drawings, the same reference numbers have been allocated to the same or analogue element.

Figure 1:
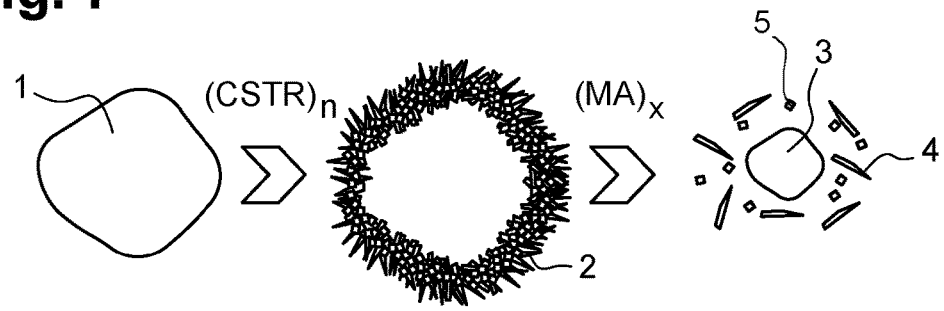
FIG. 1 is a schematic view of the status of a refractory ore material particle during one stage of alkaline oxidation and mechanical activation.

The present invention relates to an alkaline oxidation process for treating refractory sulfide ore particles enriched in a metal to be recovered.

The refractory ore particles are submitted to at least 3 stages, preferably 4, 5, 6, 7 or even 8 or up to 10 stages, in which refractory ore particles are oxidized in surface in an alkaline oxidation step in alkaline liquid phase containing calcium hydroxide for forming an alkaline slurry containing surface oxidized refractory ore particles. Thereafter the slurry is mechanically activated to remove at least partly a surface layer from the surface oxidized refractory ore particles. The surface layer contains oxidized matter. The mechanical activation forms a slurry which is called a mechanically activated slurry and which contains oxidized matter, refractory sulfide ore or concentrate particles from which said surface layer has been removed, alkaline liquid phase and liberated metal to be recovered for further processing.

The process according to the present invention is contrary to the conventional industrial practice of using lime-based reagents, where it is generally used to retard sulfide mineral oxidation. The present invention is based on the use of a lime-based reagent to induce alkaline conditions for sulfide mineral oxidation by explicitly overcoming the gypsum and iron oxide coating effect, thereby facilitating high rates of sulfide mineral oxidation.

Refractory ore is preferably crushed and milled in order to typically obtain at least 80% of particles having a diameter between 25 and 150 μm. This ore can either be fed directly into the first alkaline oxidation reactor, or can first be subjected to a mineral flotation process and thereby upgraded to a concentrate. The upgraded concentrate A, containing the metal and sulfide mineral of interest, is then be fed into the first alkaline agitated oxidation reactor. The present invention is herein illustrated with gold refractory ore, without being limited thereto. Other precious metal refractory ore can also be treated in the process according to the present invention, for example refractory ores containing silver, palladium or platinum, but also base metal sulfide ore, such as zinc sulfide ore, copper sulfide ore, cobalt sulfide ore, nickel sulfide ore or combined metal sulfide ore such as low grade copper-gold sulfide ores.

In refractory sulfide gold ore, the main sulfide minerals in the concentrate are most typically pyrite or arsenopyrite. Lime as dry quicklime, dry hydrated lime (also known as slaked lime or dry slaked lime), or a milk of lime (a slurry of $Ca(OH)_2$ particles and water) or a paste of lime may be added to at least one agitated reactor and/or to at least one mechanical activation means, preferably to at least 3 agitated reactors and/or to at least 3 mechanical activation means, more preferably to each agitated reactors and/or to at least each mechanical activation means. Lime (in any form) is added to as many of the process units (agitated reactors and/or mechanical activation means) as is required to maintain the pH throughout the processing circuit at the target pH setpoint. Practically, if the lime is added to each oxidation reactor, to maintain the pH at the setpoint, the lime consumption can be used as an indicator of the extent of mineral oxidation. Therefore it could be a very important parameter to monitor the performance of the process circuit.

It is also possible that the lime is added to each stage of the process by adding it to the attritioner feed. In this way the mechanical activation means acts to mill and disperse added lime.

The sulfide mineral concentrate (1) is subjected to a succession of alkaline oxidation ($(CSTR)_n$) and surface attritioning ($(MA)_x$) in order to reduce the impact of surface coating and passivation effects, illustrated in FIG. 1. The surface layer (2) or passivation layer (2) contains ferric iron hydroxide ($Fe(OH)_3$) and gypsum ($CaSO_4 \cdot 2H_2O$). The surface attritioning forms a slurry which is called a mechanically activated slurry and which contains oxidized matter (4), refractory sulfide ore or concentrate particles from which oxidized matter has been removed (3), alkaline liquid phase and liberated metal to be recovered (5).

The sulfide mineral concentrate is subjected to an elevated temperature alkaline oxidation process into which oxygen gas (preferably with an oxygen content greater than 95% v/v) is sparged and lime is added.

A combination of surface attritioning (mechanical activation) and alkaline oxidation, prior to gold leaching, is thereby induced. The rationale for this approach is to limit milling/grinding to achieve mineral surface attritioning (also called herein mechanical activation and encompassing both mechanical activation or attritioning) in a stirred media reactor sufficient to disrupt/alter or remove gypsum and iron oxide surface coating and passivation. In effect, the alkaline oxidation process is applied to mineral surfaces and milling (mechanical activation) is only used to expose fresh mineral surfaces ("active" layer) to sustain elevated mineral oxidation rates, as illustrated in FIG. 1. The process of mechanically activation also results in a high degree of strain being introduced into the sulphide mineral lattice, increasing the number of grain boundary fractures and lattice defects in the mineral. The introduction of strain lowers the activation energy for the oxidation of the sulfides and enables oxidation under atmospheric conditions. The rate of oxidation is also enhanced, due to the increased mineral surface area.

The process according to the present invention can occur in a number of different circuit configurations, with the basic feature of alternating alkaline oxidation (shown in CSTR reactors below) with inter-stage surface attritioning (also called mechanical activation, MA). The number of stages can range from 3-10, preferably from 3 to 8. More preferably from 4 to 7.

As it can be seen from the FIGS. 2 to 6, alkaline sulfide oxidation process for treating refractory ore particles enriched in said metal to be collected comprises said at least 3 stages comprising:

- a series of n alkaline oxidation steps in a series of n agitated reactors (CSTRs) forming n alkaline slurries, where n is an integer comprised between 3 and 10, preferably between 4 and 8, more preferably between 5 and 7, a series of x mechanical activation steps in a series of x mechanical activation means (MA), each mechanical activation step being a mechanical activation of a $n^{th}$ alkaline slurry, where x is an integer, equal to or lower than n, and comprised between 3 and 10, preferably between 4 and 8, more preferably between 5 and 7.

The series of n alkaline oxidation steps comprises at least:

a first alkaline oxidation step where said refractory ore particles enriched in a metal to be recovered are fed into an agitated reactor and form a first alkaline slurry, at least one intermediate alkaline oxidation step fed with one alkaline slurry from a previous alkaline oxidation step, a last alkaline oxidation step being said $n^{th}$ alkaline oxidation step fed with one alkaline slurry from a previous alkaline oxidation step.

Said series of x mechanical activation steps comprises at least:

a first mechanical activation step of said first alkaline slurry in a first mechanical activation means to form a first mechanically activated slurry.

at least one intermediate mechanical activation step of a $n^{th}$ alkaline slurry with said $n^{th}$ alkaline slurry being comprised between a $2^{nd}$ alkaline slurry and a $(x-1)^{th}$ alkaline slurry in an intermediate ($y^{th}$) mechanical activation means to form an intermediate ($y^{th}$) mechanically activated slurry, a last mechanical activation step of said last alkaline slurry being said $x^{th}$ mechanical activation step in a $x^{th}$ mechanical activation means to form a last mechanically activated slurry.

Figure 2:
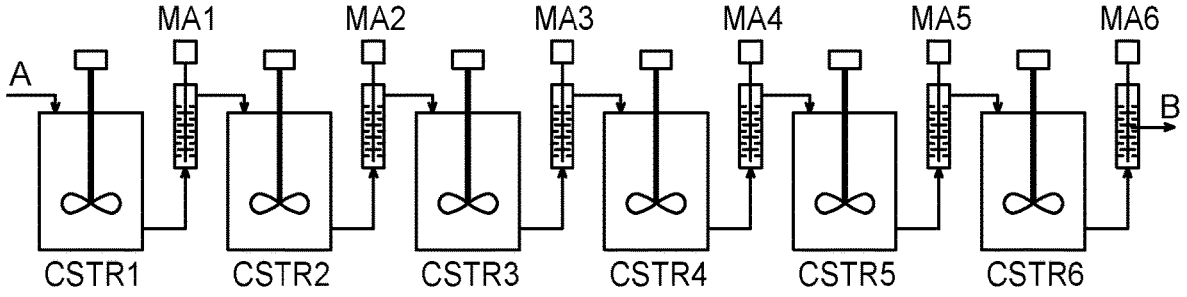
FIG. 2 is a flow chart of one embodiment of the process according to the present invention, showing the device to carry out such process.

A first embodiment is illustrated in FIG. 2. As it can be seen, the series of n reactor comprises 6 agitated reactors. Each agitated reactor (CSTR 1 to CSTR 6) is followed by one mechanical activation means (MA 1 to MA 6). In this embodiment of FIG. 2, x=n=6. The first agitated reactor is fed with refractory ore particles, having preferably a $P_{80}$ lower than 150 μm. Each alkaline oxidation step of said series of n alkaline oxidation step is followed by a mechanical activation step of said series of x mechanical activation steps. Each $n^{th}$ alkaline oxidation step forms a $n^{th}$ slurry of surface oxidized refractory ore particles. Each $n^{th}$ alkaline oxidation step from n=2 is fed by a $x^{th}$ mechanically activated slurry where x=n−1. Each $x^{th}$ mechanical activation step forms a $x^{th}$ mechanically activated slurry.

In other words, the first alkaline oxidation step in agitated reactor CSTR 1 forms a first slurry of surface oxidized refractory ore particles and is followed by a first mechanical activation step in a mechanical activation means MA1. The first mechanical activation forms a first mechanically activated slurry. The first alkaline oxidation step is fed by refractory ore particles.

The second alkaline oxidation step in agitated reactor CSTR 2 forms a second slurry of surface oxidized refractory ore particles and is followed by a second mechanical activation step in a mechanical activation means MA 2. The second mechanical activation forms a second mechanically activated slurry. The second alkaline oxidation step is fed by the first mechanically activated slurry.

The third alkaline oxidation step in agitated reactor CSTR 3 forms a third slurry of surface oxidized refractory ore particles and is followed by a third mechanical activation step in a mechanical activation means MA 3. The third mechanical activation forms a third mechanically activated slurry. The third alkaline oxidation step is fed by the second mechanically activated slurry.

The fourth alkaline oxidation step in agitated reactor CSTR 4 forms a fourth slurry of surface oxidized refractory ore particles and is followed by a fourth mechanical activation step in a mechanical activation means MA 4. The fourth mechanical activation forms a fourth mechanically activated slurry. The fourth alkaline oxidation step is fed by the third mechanically activated slurry.

The fifth alkaline oxidation step in agitated reactor CSTR 5 forms a fifth slurry of surface oxidized refractory ore particles and is followed by a fifth mechanical activation step in a mechanical activation means MA 5. The fifth mechanical activation forms a fifth mechanically activated slurry. The fifth alkaline oxidation step is fed by the fourth mechanically activated slurry.

The sixth alkaline oxidation step in agitated reactor CSTR 6 forms a sixth slurry of surface oxidized refractory ore particles and is followed by a sixth mechanical activation step in a mechanical activation means MA 6. The sixth mechanical activation forms a sixth mechanically activated slurry. The sixth alkaline oxidation step is fed by the fifth mechanically activated slurry.

Figure 3:
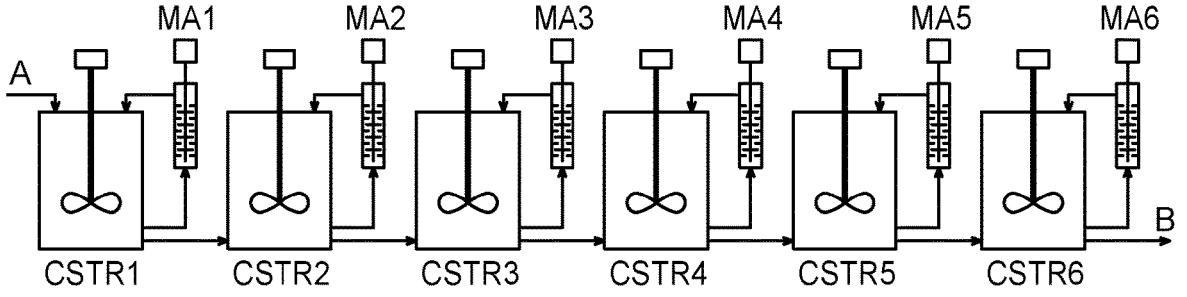
FIG. 3 is a flow chart of another embodiment of the process according to the present invention, showing the device to carry out such process.

In another alternative arrangement as illustrated in FIG. 3, the atritioners or mechanical activation means (MA 1 to MA 6) will not be between the alkaline oxidation stages (CSTR 1 to CSTR 6), but rather in parallel with the oxidation stages, forming an internal loop between the alkaline oxidation reactor and the mechanical activation reactor.

The equipment arrangement would have preferably 4 to 6 reactors for alkaline oxidation, with 4 to 6 atritioners "next to" the reactors.

In this case, the slurry is drawn from a $n^{th}$ agitated reactor, sent through the attritioner, which then returns the slurry to the same $n^{th}$ reactor.

This arrangement offers the added benefit that the circuit may continue to operate even if an atritioner needs to be taken offline for maintenance or replacement. It also provides more flexibility to alter the relative extent of attritioning vs oxidation, by adjusting the return (to the same oxidation reactor) versus the forwarding (to the next oxidation reactor in the series) flow rate. Also, not all alkaline oxidation stages may require a mechanical activation step, therefore some mechanical activation steps can be omitted (see FIG. 5).

Indeed, as illustrated in FIG. 3, in this arrangement, the number of agitated reactors in said series is preferably 6 and the number of mechanical activation means in said series is also preferably 6.

Accordingly, x=n=6. Each alkaline oxidation step of said series of n alkaline oxidation step is followed by a mechanical activation step of said series of x mechanical activation steps. Each $n^{th}$ alkaline oxidation step forms a $n^{th}$ slurry of surface oxidized refractory ore particles. The $n^{th}$ alkaline oxidation step is fed by a $(n-1)^{th}$ slurry from a $(n-1)^{th}$ agitated reactor to which a $(n-1)^{th}$ mechanically activated slurry is returned.

In other words, the first alkaline oxidation step in agitated reactor CSTR 1 forms a first slurry of surface oxidized refractory ore particles and is followed by a first mechanical activation step in a mechanical activation means MA1. The first mechanical activation forms a first mechanically activated slurry. The first alkaline oxidation step is fed by refractory ore particles and by said first mechanically activated slurry.

The second alkaline oxidation step in agitated reactor CSTR 2 forms a second slurry of surface oxidized refractory ore particles and is followed by a second mechanical activation step in a mechanical activation means MA 2. The second mechanical activation forms a second mechanically activated slurry. The second alkaline oxidation step is fed by the first slurry from the first agitated reactor and by the second mechanically activated slurry.

The third alkaline oxidation step in agitated reactor CSTR 3 forms a third slurry of surface oxidized refractory ore particles and is followed by a third mechanical activation step in a mechanical activation means MA 3. The third mechanical activation forms a third mechanically activated slurry. The third alkaline oxidation step is fed by the second slurry from the second agitated reactor and by the third mechanically activated slurry.

The fourth alkaline oxidation step in agitated reactor CSTR 4 forms a fourth slurry of surface oxidized refractory ore particles and is followed by a fourth mechanical activation step in a mechanical activation means MA 4. The fourth mechanical activation forms a fourth mechanically activated slurry. The fourth alkaline oxidation step is fed by the third slurry from the third agitated reactor and by the fourth mechanically activated slurry.

The fifth alkaline oxidation step in agitated reactor CSTR 5 forms a fifth slurry of surface oxidized refractory ore particles and is followed by a fifth mechanical activation step in a mechanical activation means MA 5. The fifth mechanical activation forms a fifth mechanically activated slurry. The fifth alkaline oxidation step is fed by the fourth slurry from the fourth agitated reactor and by the fifth mechanically activated slurry.

The sixth alkaline oxidation step in agitated reactor CSTR 6 forms a sixth slurry of surface oxidized refractory ore particles and is followed by a sixth mechanical activation step in a mechanical activation means MA 6. The sixth mechanical activation forms a sixth mechanically activated slurry. The sixth alkaline oxidation step is fed by the fifth slurry from the fifth agitated reactor and by the sixth mechanically activated slurry.

Figure 4:
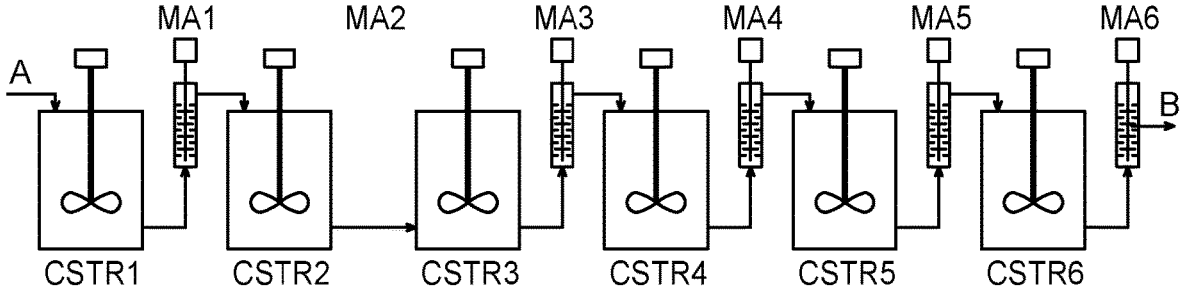
FIG. 4 is a flow chart of yet another embodiment of the process according to the present invention, showing the device to carry out such process.

FIG. 4 illustrates a variant embodiment compared to FIG. 2, where the number of agitated reactors in said series of n agitated reactor is not the same as the number of mechanical activation means of said series of x mechanical activation means. This arrangement can be carried out as such or at any location in the series and can be carried out as illustrated by construction or because one mechanical activation means needs to be maintained. In this case, a by-pass is realized between two consecutive agitated reactors.

As it can be seen, in this arrangement, x is different from n, hence lower than n. x=5 while n=6. Some alkaline oxidation step of said series of n alkaline oxidation step are followed by a mechanical activation step of said series of x mechanical activation steps, but not each alkaline oxidation steps. Each $n^{th}$ alkaline oxidation step forms a $n^{th}$ slurry of surface oxidized refractory ore particles and is fed by a $(n-1)^{th}$ slurry from the $(n-1)^{th}$ agitated reactor, optionally subsequently mechanically activated.

In other words, the first alkaline oxidation step in agitated reactor CSTR 1 forms a first slurry of surface oxidized refractory ore particles and is followed by a first mechanical activation step in a mechanical activation means MA1. The first mechanical activation forms a first mechanically activated slurry. The first alkaline oxidation is fed by refractory ore particles.

The second alkaline oxidation step in agitated reactor CSTR 2 forms a second slurry of surface oxidized refractory ore particles. The second alkaline oxidation step is fed by the first mechanically activated slurry.

The third alkaline oxidation step in agitated reactor CSTR 3 forms a third slurry of surface oxidized refractory ore particles and is followed by a second mechanical activation step in a mechanical activation means MA 2. The second mechanical activation forms a second mechanically activated slurry. The third alkaline oxidation step is fed by the second slurry from the second alkaline oxidation step.

The fourth alkaline oxidation step in agitated reactor CSTR 4 forms a fourth slurry of surface oxidized refractory ore particles and is followed by a third mechanical activation step in a mechanical activation means MA 3. The third mechanical activation forms a third mechanically activated slurry. The fourth alkaline oxidation step is fed by the second mechanically activated slurry.

The fifth alkaline oxidation step in agitated reactor CSTR 5 forms a fifth slurry of surface oxidized refractory ore particles and is followed by a fourth mechanical activation step in a mechanical activation means MA 4. The fourth mechanical activation forms a fourth mechanically activated slurry. The fifth alkaline oxidation step is fed by the third mechanically activated slurry.

The sixth alkaline oxidation step in agitated reactor CSTR 6 forms a sixth slurry of surface oxidized refractory ore particles and is followed by a fifth mechanical activation step in a mechanical activation means MA 5. The fifth mechanical activation forms a fifth mechanically activated slurry. The sixth alkaline oxidation step is fed by the fourth mechanically activated slurry.

Figure 5:
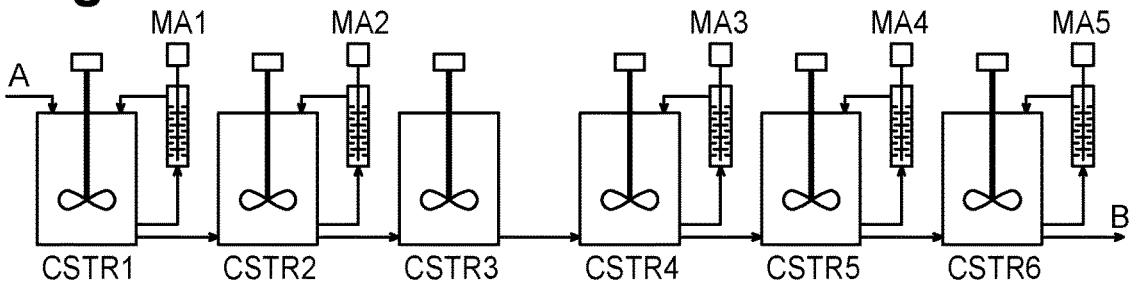
FIG. 5 is a flow chart of a further embodiment of the process according to the present invention, showing the device to carry out such process.

FIG. 5 illustrates a variant embodiment compared to FIG. 3, where the number of agitated reactor in said series of n agitated reactor is not the same as the number of mechanical activation means of said series of x mechanical activation means. This arrangement can be carried out as such or at any location in the series and can be carried out as illustrated by construction or because one mechanical activation means needs to be maintained, as afore explained.

As it can be seen, in this arrangement, x is different from n, and lower than n. x=5 while n=6. Some alkaline oxidation step of said series of n alkaline oxidation steps (CSTR 1 to CSTR 6) being followed by a mechanical activation step of said series of x mechanical activation steps (MA 1 to MA 5). Each nth alkaline oxidation step forming a nth slurry of surface oxidized refractory ore particles and being fed from a (n−1)th agitated reactor optionally to which a xth mechanically activated slurry with $x<(n-1)$ is returned.

In other words, the first alkaline oxidation step in agitated reactor CSTR 1 forms a first slurry of surface oxidized refractory ore particles and is followed by a first mechanical activation step in a mechanical activation means MA1. The first mechanical activation forms a first mechanically activated slurry. The first alkaline oxidation is fed by refractory ore particles and by said first mechanically activated slurry.

The second alkaline oxidation step in agitated reactor CSTR 2 forms a second slurry of surface oxidized refractory ore particles and is followed by a second mechanical activation step in a mechanical activation means MA 2. The second mechanical activation forms a second mechanically activated slurry. The second alkaline oxidation step is fed by the first slurry from the first agitated reactor and by the second mechanically activated slurry.

The third alkaline oxidation step in agitated reactor CSTR 3 forms a third slurry of surface oxidized refractory ore particles. The third alkaline oxidation step is fed by the second slurry from the second agitated reactor.

The fourth alkaline oxidation step in agitated reactor CSTR 4 forms a fourth slurry of surface oxidized refractory ore particles and is followed by a third mechanical activation step in a mechanical activation means MA 3. The third mechanical activation forms a third mechanically activated slurry. The fourth alkaline oxidation step is fed by the third slurry from the third agitated reactor and by the third mechanically activated slurry.

The fifth alkaline oxidation step in agitated reactor CSTR 5 forms a fifth slurry of surface oxidized refractory ore particles and is followed by a fourth mechanical activation step in a mechanical activation means MA 4. The fourth mechanical activation forms a fourth mechanically activated slurry. The fifth alkaline oxidation step is fed by the fourth slurry from the fourth agitated reactor and by the fourth mechanically activated slurry.

The sixth alkaline oxidation step in agitated reactor CSTR 6 forms a sixth slurry of surface oxidized refractory ore particles and is followed by a fifth mechanical activation step in a mechanical activation means MA 5. The fifth mechanical activation forms a fifth mechanically activated slurry. The sixth alkaline oxidation step is fed by the fifth slurry from the fifth agitated reactor and by the fifth mechanically activated slurry.

Figure 6:
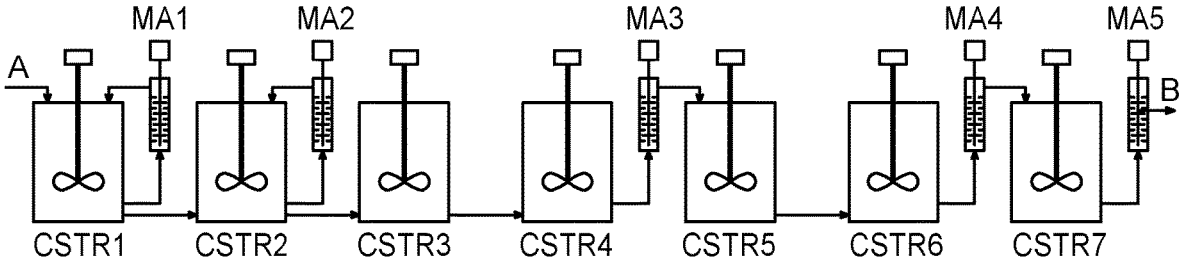
FIG. 6 is a flow chart of a variant embodiment of the process according to the present invention, showing the device to carry out such process.

FIG. 6 shows another arrangement in which a combination of several variants is illustrated.

In this embodiment, the first alkaline oxidation step in agitated reactor CSTR 1 forms a first slurry of surface oxidized refractory ore particles and is followed by a first mechanical activation step in a mechanical activation means MA 1. The first mechanical activation forms a first mechanically activated slurry. The first alkaline oxidation is fed by refractory ore particles and the first mechanically activated slurry.

The second alkaline oxidation step in agitated reactor CSTR 2 forms a second slurry of surface oxidized refractory ore particles and is followed by a second mechanical activation step in a mechanical activation means MA 2. The second mechanical activation forms a second mechanically activated slurry. The second alkaline oxidation step is fed by the first slurry from the first agitated reactor and by the second mechanically activated slurry.

The third alkaline oxidation step in agitated reactor CSTR 3 forms a third slurry of surface oxidized refractory ore particles. The third alkaline oxidation step is fed by the second slurry from the second agitated reactor.

The fourth alkaline oxidation step in agitated reactor CSTR 4 forms a fourth slurry of surface oxidized refractory ore particles and is followed by a third mechanical activation step in a mechanical activation means MA 3. The third mechanical activation forms a third mechanically activated slurry. The fourth alkaline oxidation step is fed by the third slurry from the third agitated reactor.

The fifth alkaline oxidation step in agitated reactor CSTR 5 forms a fifth slurry of surface oxidized refractory ore particles. The fifth alkaline oxidation step is fed by the third mechanically activated slurry from the third mechanical activation means.

The sixth alkaline oxidation step in agitated reactor CSTR 6 forms a sixth slurry of surface oxidized refractory ore particles and is followed by a fourth mechanical activation step in a mechanical activation means MA 4. The fourth mechanical activation forms a fourth mechanically activated slurry. The sixth alkaline oxidation step is fed by the fifth slurry from the fifth agitated reactor.

The seventh alkaline oxidation step in agitated reactor CSTR 7 forms a seventh slurry of surface oxidized refractory ore particles and is followed by a fifth mechanical activation step in a mechanical activation means MA 5. The fifth mechanical activation forms a fifth mechanically activated slurry. The seventh alkaline oxidation step is fed by the fourth mechanically activated slurry from the fourth mechanical activation means.

According to the present invention, further possible separation steps can be foreseen between two agitated oxidation reactors or between one mechanical activation means and one agitated reactor, such as for example to remove a portion of said liquid phase and keeping a higher concentration in solid matter in a further alkaline oxidation step.

In the process according to the present invention, the conditions for alkaline oxidation process are preferably as follows:

Pressure: atmospheric

Solids concentration: 40-65% wt

Temperature: 80-90 °C.

Dissolved oxygen: 2-30 mg/dm$^3$ (preferably >10 mg/dm$^3$)

pH control level: 11 with controlled lime addition

Lime reagent addition into the oxidation reactors (CSTR) and stirred media (attritioning or mechanical activation) reactors can be achieved either by addition of dry quicklime (CaO—in powder form), lime hydrate ($Ca(OH)_2$—in powder form), or milk of lime also known as slaked lime slurry (a suspension of $Ca(OH)_2$). The lime addition rate would be dependent upon reaction demand and maintaining the pH at 11 in all alkaline oxidation reactors. Said lime addition in the oxidation reactors and mechanical activation means is performed in an usual known manner which is not illustrated on the Figures.

The heat for maintaining the temperature at or above 80 °C is derived from the stirred media reactor as well as the exothermic chemical reactions and is sustained by managing the various heat balance factors of the processing circuit. These heat balance factors are specific to each application scenario and should be evaluated for each individual scenario as key inputs into the process design and selection of lime reagent type. The mass feed and subsequent rate of sulfide oxidation, as well the type of lime reagent used are particularly relevant to the heat balance.

The alkaline oxidation reaction, summarized by the overall reaction below, is exothermic (ΔH −1732 kJ/mol @ 30 °C) thereby contributing to heat generation in the agitated reactor.

$$4FeS_2+8Ca(OH)_2+15O_2+14H_2O=4Fe(OH)_3+8CaSO_4\cdot 2H_2O$$

The hydration reaction of quicklime is also exothermic (ΔH−65 kJ/mol @ 30 °C.).

$$CaO+H_2O=Ca(OH)_2$$

The choice of lime reagent in the form of CaO, compared to already-hydrated $Ca(OH)_2$ may impact the heat balance, and may be used to manage the amount of heat in the process.

Oxygen is supplied preferably in each oxidation reactor in a known manner which is not illustrated on the Figures. Oxygen utilization efficiency may also be improved by making use of a cascade of multiple oxidation reactors where the oxygen gas from one reactor is captured and introduced to a next reactor vessel in the cascade.

A key design element of the processing circuit is the extent of pyrite (or other sulfide mineral) oxidation to be targeted, as this is the key driver for determining the extent surface attrition, the extent of oxidation and therefore also the extent of lime and oxygen reagent requirement. In turn, these factors influence the process residence time and thereby the reactor size. These factors thus also influence the operational and capital costs of the processing circuit.

Figure 7:
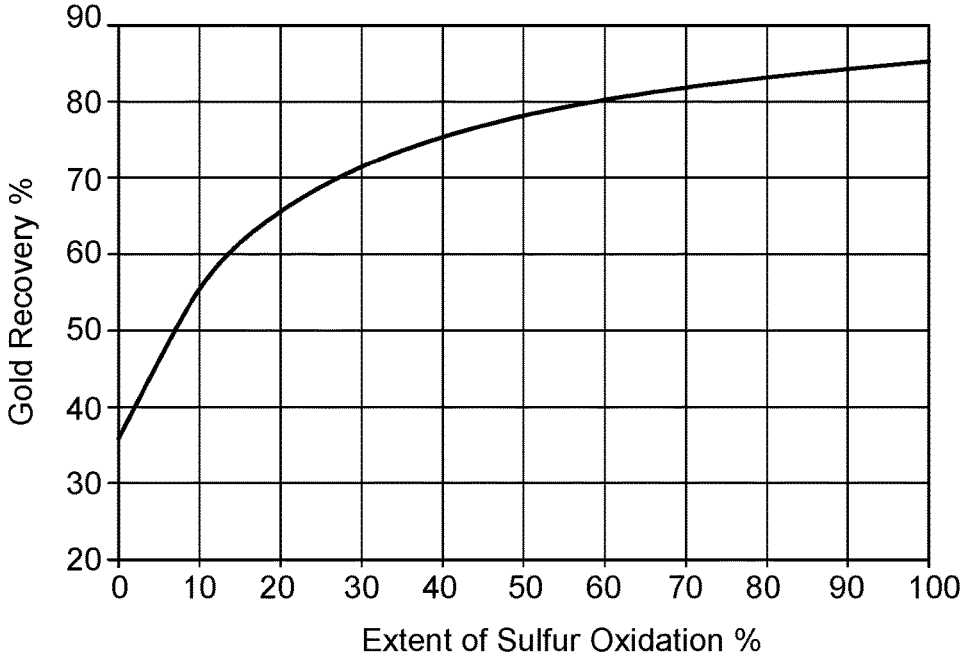
FIG. 7 is a graph showing the extent of gold extraction by cyanidation leaching (or other target method) as a function of extent of pyrite oxidation.

The optimal solids content is determined by optimal viscosity of the solids slurry. A too viscous slurry will reduce the efficiency of oxygen mass transfer and would negatively impact the efficiency of attritioning. The design of the process circuit should take into account that the that the solids content, and thus viscosity, of the slurry will increase through the circuit as a result of increased gypsum generation. The process design should take into consideration this increased viscosity and the optimal viscosity for oxygen transfer and attritioning or mechanical activation. Dilution process water may also be introduced along the process circuit to reduce the solids concentration and viscosity if required to maintain optimal conditions The extent of gold extraction by cyanidation leaching (or other target method) should be determined as a function of extent of pyrite oxidation, as is known in the art and shown by way of example in the graph in FIG. 7.

The process circuit design, and in particular the extent of surface attritioning and oxidation is based on obtaining key process design parameters experimentally. Lime consumption (to maintain the pH at a setpoint of 11), can be used as an indicator or proxy of the extent of pyrite oxidation because of the correlation via the reaction mechanism:

$$4FeS_2+8Ca(OH)_2+15O_2+14H_2O=4Fe(OH)_3+8CaSO_4\cdot 2H_2O$$

Once initial oxidation is commenced, using the concentrate feed A at particle size as obtained from the mineral flotation process, lime and/or oxygen consumption is monitored (according to the above reaction) until a plateau is reached indicating the onset of the particle coating effect caused by gypsum and iron oxides. The mineral slurry is then transferred to a surface attritioning step to induce surface cleaning for a monitored period of time, that can be adjusted as required. Oxidation is again resumed in the same way until a lime/oxygen consumption plateau is reached. The stage of said series of at least 3 stages is repeated until no further oxidation occurs.

The lime consumption is correlated with the oxygen consumption via the reaction mechanism, which allows for the oxygen demand for the system to be calculated and the oxygen supply system to be designed for the oxidation reactors.

It should be understood that the present invention is not limited to the described embodiments and that variations can be applied without going outside of the scope of the claims.

The invention claimed is:

1. An alkaline oxidation process for treating refractory sulfide ore particles having a sulfide mineral lattice, said refractory sulfide ore particles being enriched in a metal to be recovered, and wherein said refractory sulfide ore particles are submitted to at least 3 stages in each of which said refractory sulfide ore particles are surface-oxidized by an oxidizing agent in an alkaline oxidation step in alkaline liquid phase and form an alkaline slurry containing surface oxidized refractory sulfide ore particles having a passivation layer, at least one alkaline oxidation step being performed at a pH comprised between 10 and 12.5, and in each of which said alkaline slurry is thereafter submitted to a mechanical activation step for at least partly removing a surface layer containing oxidized matter from the surface-oxidized refractory sulfide ore particles, said mechanical activation forming a mechanically activated slurry containing oxidized matter, refractory sulfide ore particles from which oxidized matter has been removed, alkaline liquid phase and liberated metal to be recovered by further processing or returned to a next or a previous alkaline oxidation step, said alkaline liquid phase containing calcium hydroxide as an alkaline agent and said refractory sulfide ore being a refractory sulfide ore or concentrate enriched in a metal selected from the group consisting of gold, silver, platinum, palladium, copper, nickel, zinc, cobalt and combinations thereof, said at least 3 stages comprising:

a series of n alkaline oxidation steps in a series of n reactors, each $n^{th}$ alkaline oxidation forming a $n^{th}$ alkaline slurry, where n is an integer comprised between 3 and 10, a series of x mechanical activation steps, each mechanical activation step being a mechanical activation of said $n^{th}$ alkaline slurry, where x is an integer, equal to or lower than n, and comprised between 3 and 10, wherein said series of n alkaline oxidation steps comprises at least:

a first alkaline oxidation step where said refractory ore particles enriched in a metal to be recovered is fed into an agitated reactor and forming a first alkaline slurry, at least one intermediate alkaline oxidation step fed with one alkaline slurry from a previous alkaline oxidation step, a last alkaline oxidation step being said $n^{th}$ alkaline oxidation step fed with one alkaline slurry from a previous alkaline oxidation step, said series of x mechanical activation steps comprising at least:

a first mechanical activation step of said first alkaline slurry in a first mechanical activation means to form a first mechanically activated slurry, at least one intermediate mechanical activation step of a $n^{th}$ alkaline slurry with said $n^{th}$ alkaline slurry being comprised between a $2^{nd}$ alkaline slurry and a $(x-1)^{th}$ alkaline slurry in an intermediate mechanical activation means to form an intermediate mechanically activated slurry, a last mechanical activation step of said last alkaline slurry being said $x^{th}$ mechanical activation step in a $x^{th}$ mechanical activation means to form a $x^{th}$ mechanically activated slurry, wherein the said mechanical activation is to introduce strains into the sulfide mineral lattice and to expose fresh mineral surface, thereby to sustain mineral oxidation rates and wherein each step of mechanical activation follows a step of alkaline oxidation step, wherein the said mechanical activation step is performed in a way to only remove or alter the passivation layer, this way of performing the mechanical activation step resulting in energy savings.

2. An alkaline oxidation process for treating refractory sulfide ore particles having a sulfide mineral lattice, said refractory sulfide ore particles being enriched in a metal to be recovered, and wherein said refractory sulfide ore particles are submitted to at least 3 stages in each of which said refractory sulfide ore particles are surface-oxidized by an oxidizing agent in an alkaline oxidation step in alkaline liquid phase and form an alkaline slurry containing surface oxidized refractory sulfide ore particles having a passivation layer, at least one alkaline oxidation step being performed at a pH comprised between 10 and 12.5, and in each of which said alkaline slurry is thereafter submitted to a mechanical activation step for at least partly removing a surface layer containing oxidized matter from the surface-oxidized refractory sulfide ore particles, said mechanical activation forming a mechanically activated slurry containing oxidized matter, refractory sulfide ore particles from which oxidized matter has been removed, alkaline liquid phase and liberated metal to be recovered by further processing or returned to a next or a previous alkaline oxidation step, said alkaline liquid phase containing calcium hydroxide as an alkaline agent and said refractory sulfide ore being a refractory sulfide ore or concentrate enriched in a metal selected from the group consisting of gold, silver, platinum, palladium, copper, nickel, zinc, cobalt and combinations thereof, said at least 3 stages comprising:

a series of n alkaline oxidation steps in a series of n reactors, each $n^{th}$ alkaline oxidation forming a $n^{th}$ alkaline slurry, where n is an integer comprised between 3 and 10, a series of x mechanical activation steps, each mechanical activation step being a mechanical activation of said $n^{th}$ alkaline slurry, where x is an integer, equal to or lower than n, and comprised between 3 and 10, wherein said series of n alkaline oxidation steps comprises at least:

a first alkaline oxidation step where said refractory ore particles enriched in a metal to be recovered is fed into an agitated reactor and forming a first alkaline slurry, at least one intermediate alkaline oxidation step fed with one alkaline slurry from a previous alkaline oxidation step, a last alkaline oxidation step being said nth alkaline oxidation step fed with one alkaline slurry from a previous alkaline oxidation step said series of x mechanical activation steps comprising at least:

a first mechanical activation step of said first alkaline slurry in a first mechanical activation means to form a first mechanically activated slurry at least one intermediate mechanical activation step of a nth alkaline slurry with said $n^{th}$ alkaline slurry being comprised between a 2nd alkaline slurry and a $(x-1)^{th}$ alkaline slurry in an intermediate mechanical activation means to form an intermediate mechanically activated slurry, a last mechanical activation step of said last alkaline slurry being said $x^{th}$ mechanical activation step in a $x^{th}$ mechanical activation means to form a $x^{th}$ mechanically activated slurry, wherein said refractory sulfide ore particles fed to said first alkaline oxidation step are obtained by a previous crushing and grinding, down to having 80% of the particles with a diameter in the range between 25 and 200 μm, wherein the said mechanical activation step is to introduce strains into the sulfide mineral lattice and to expose fresh mineral surface, thereby to sustain mineral oxidation rates and wherein each step of mechanical activation follows an alkaline oxidation step, wherein the said mechanical activation step is performed in a way to only remove or alter the passivation layer, this way of performing the mechanical activation step resulting in energy savings.

3. An alkaline oxidation process for treating refractory sulfide ore particles enriched in a metal to be recovered wherein refractory sulfide ore particles are submitted to at least 3 stages in each of which said refractory sulfide ore particles are surface-oxidized by an oxidizing agent in an alkaline oxidation step in alkaline liquid phase and form an alkaline slurry containing surface oxidized refractory sulfide ore particles, at least one alkaline oxidation step being performed at a pH comprised between 10 and 12.5, and in each of which said alkaline slurry is thereafter submitted to a mechanical activation step for at least partly removing a surface layer containing oxidized matter from the surface-oxidized refractory sulfide ore particles, said mechanical activation forming a mechanically activated slurry containing oxidized matter, refractory sulfide ore particles from which oxidized matter has been removed, alkaline liquid phase and liberated metal to be recovered by further processing or returned to a next or a previous alkaline oxidation step, said alkaline liquid phase containing calcium hydroxide as an alkaline agent and said refractory sulfide ore being a refractory sulfide ore or concentrate enriched in a metal selected from the group consisting of gold, silver, platinum, palladium, copper, nickel, zinc, cobalt and combinations thereof, said at least 3 stages comprising:

a series of n alkaline oxidation steps in a series of n reactors, each nth alkaline oxidation forming a nth alkaline slurry, where n is an integer comprised between 3 and 10, a series of x mechanical activation steps, each mechanical activation step being a mechanical activation of said $n^{th}$ alkaline slurry, where x is an integer, equal to or lower than n, and comprised between 3 and 10, wherein said series of n alkaline oxidation steps comprises at least:

a first alkaline oxidation step wherein said refractory ore particles enriched in a metal to be recovered are fed into an agitated reactor and form a first alkaline slurry, at least one intermediate alkaline oxidation step fed with one alkaline slurry from a previous alkaline oxidation step, a last alkaline oxidation step being said nth alkaline oxidation step fed with one alkaline slurry from a previous alkaline oxidation step, said series of x mechanical activation steps comprising at least:

a first mechanical activation step of said first alkaline slurry in a first mechanical activation means to form a first mechanically activated slurry, at least one intermediate mechanical activation step of a nth alkaline slurry being carried out in series with said nth alkaline slurry being comprised between a 2nd alkaline slurry and a $(x-1)^{th}$ alkaline slurry in an intermediate mechanical activation means to form an intermediate mechanically activated slurry, a last mechanical activation step of said last alkaline slurry being said $x^{th}$ mechanical activation step in a $x^{th}$ mechanical activation means to form an $x^{th}$ mechanically activated slurry, wherein the ore is enriched with an element selected from the group consisting of copper, zinc and a combination of copper and zinc.

* * * * *